US010192649B2

(12) United States Patent
Nishi et al.

(10) Patent No.: US 10,192,649 B2
(45) Date of Patent: Jan. 29, 2019

(54) ALUMINUM ALLOY CONDUCTOR, INSULATED WIRE INCLUDING THE CONDUCTOR, AND METHOD FOR MANUFACTURING THE INSULATED WIRE

(71) Applicant: HITACHI METALS, LTD., Tokyo (JP)

(72) Inventors: Kazuya Nishi, Tokyo (JP); Toru Sumi, Tokyo (JP); Shohei Hata, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/909,517

(22) Filed: Mar. 1, 2018

(65) Prior Publication Data

US 2018/0254118 A1 Sep. 6, 2018

(30) Foreign Application Priority Data

Mar. 2, 2017 (JP) ..... 2017-039174

(51) Int. Cl.

| | |
|---|---|
| ***H01B 1/02*** | (2006.01) |
| ***H01B 7/00*** | (2006.01) |
| ***H01B 5/08*** | (2006.01) |
| ***C22C 21/00*** | (2006.01) |
| ***C22F 1/04*** | (2006.01) |

(52) U.S. Cl.

CPC ..... *H01B 1/023* (2013.01); *C22C 21/00* (2013.01); *C22F 1/04* (2013.01); *H01B 5/08* (2013.01); *H01B 7/0045* (2013.01)

(58) Field of Classification Search

CPC ..... H01B 1/023; H01B 5/08; H01B 7/0045

See application file for complete search history.

(56) References Cited

U.S. PATENT DOCUMENTS

| | | | |
|---|---|---|---|
| 2013/0264115 | A1 | 10/2013 | Kobayashi et al. |
| 2015/0235729 | A1 | 8/2015 | Yoshida et al. |

FOREIGN PATENT DOCUMENTS

| | | | |
|---|---|---|---|
| CA | 967405 | A | 5/1975 |
| JP | 48-000014 | A | 1/1973 |
| JP | 52-035114 | A | 3/1977 |
| JP | 2012-229485 | A | 11/2012 |
| JP | 2016-108617 | A | 6/2016 |
| WO | 2014/155820 | A1 | 10/2014 |
| WO | 2016/088888 | A1 | 6/2016 |

OTHER PUBLICATIONS

Japanese Office Action dated Jul. 3, 2018 for the Japanese Patent Application No. 2017-039174.

*Primary Examiner* — Jeremy C Norris

(74) *Attorney, Agent, or Firm* — Volpe and Koenig, P.C.

(57) ABSTRACT

It is an objective of the invention to provide an Al alloy conductor exhibiting mechanical properties and heat resistance that are balanced at a higher level than conventional Al alloy conductors while having an electrical conductivity comparable to that of any conventional Al-based material. There is provided an Al alloy conductor formed of an Al alloy. The Al alloy has a chemical composition including Co of 0.1 mass % or more and 1 mass % or less, at least one of Sc of 0.1 mass % or more and 0.5 mass % or less and Zr of 0.2 mass % or more and 0.5 mass % or less, and the balance made up of Al and inevitable impurities. The Al alloy conductor has a matrix containing fine particles of a compound of at least one of the Sc and the Zr with the Al. The fine particles are dispersedly precipitated in the matrix.

17 Claims, 2 Drawing Sheets

ALUMINUM ALLOY CONDUCTOR, INSULATED WIRE INCLUDING THE CONDUCTOR, AND METHOD FOR MANUFACTURING THE INSULATED WIRE

CLAIM OF PRIORITY

The present application claims priority from Japanese patent application serial no. 2017-039174 filed on Mar. 2, 2017, the content of which is hereby incorporated by reference into this application.

FIELD OF THE INVENTION

The present invention relates to techniques of aluminum-based conductors and, in particular, to an aluminum alloy conductor exhibiting mechanical properties and heat resistance that are balanced at a higher level than conventional aluminum alloy conductors while having an electrical conductivity comparable to that of any conventional aluminum-based conductor, an insulated wire including the conductor, and a method for manufacturing the insulated wire.

DESCRIPTION OF THE RELATED ART

In recent years, there has been a rapid growth in the number of electric/electronic control mechanisms and devices for improved comfortability and safety in vehicles such as automobiles, trains, and aircraft. Accordingly, the amount of electrical/electronic wiring installed in such vehicles has been steadily increasing. On the other hand, a considerable effort is being made for weight reduction of such vehicles with an aim to reduce energy consumption, which is required to protect the environment.

Conventionally, copper materials (e.g. JIS C1100) have been widely used as electrical/electronic wiring materials. However, as mentioned above, the increase in vehicle weight accompanying the increase in the amount of electrical/electronic wiring has reached such a level that it cannot be ignored. In order to respond to these contradicting phenomena, changing the materials for electrical/electronic wiring conductors from copper materials, which are large in specific gravity, to aluminum materials, which are small in specific gravity, is currently under study.

However, since pure aluminum materials (e.g. JIS A1060) are inferior to copper materials in mechanical properties and heat resistance, simply switching them has been difficult from the viewpoint of durability and reliability required of electrical/electronic wiring. Therefore, various attempts have been made to develop an aluminum alloy that exhibits excellent mechanical properties and heat resistance while maintaining good electrical conductivity.

For example, JP 2012-229485 A discloses an aluminum alloy wire for use as a conductor. The aluminum alloy wire contains, by mass, 0.03% or more and 1.5% or less of Mg, 0.02% or more and 2.0% or less of Si, a total of 0.1% or more and 1.0% or less of at least one element selected from Cu, Fe, Cr, Mn and Zr, and the balance of Al and impurities. The wire has an electrical conductivity of 40% IACS or more, a tensile strength of 150 MPa or more, an elongation of 5% or more, a wire diameter of 0.5 mm or less, and a maximum grain size of 50 μm or less.

JP 2016-108617 A discloses an aluminum alloy wire containing 0.1 to 1.0 mass % of Mg, 0.1 to 1.2 mass % of Si, 0.01 to 1.40 mass % of Fe, 0 to 0.100 mass % of Ti, 0 to 0.030 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Zr, 0 to 0.50 mass % of Hf, 0 to 0.50 mass % of V, 0 to 0.50 mass % of Sc, 0 to 0.50 mass % of Co, 0 to 0.50 mass % of Ni, and the balance of Al and inevitable impurities. In the aluminum alloy wire, the number $N_{out}$ of precipitates containing Mg and/or Si with a diameter of 1 μm or less at the outer circumferential part is larger than the number $N_{in}$ of precipitates containing Mg and/or Si with a diameter of 1 μm or less at the inside.

Also, WO 2016/088888 A1 discloses an aluminum alloy wire having a composition of 0.10 to 1.00 mass % of Mg, 0.10 to 1.00 mass % of Si, 0.01 to 1.40 mass % of Fe, 0 to 0.100 mass % of Ti, 0 to 0.030 mass % of B, 0 to 1.00 mass % of Cu, 0 to 0.50 mass % of Ag, 0 to 0.50 mass % of Au, 0 to 1.00 mass % of Mn, 0 to 1.00 mass % of Cr, 0 to 0.50 mass % of Zr, 0 to 0.50 mass % of Hf, 0 to 0.50 mass % of V, 0 to 0.50 mass % of Sc, 0 to 0.50 mass % of Sn, 0 to 0.50 mass % of Co, 0 to 0.50 mass % of Ni, and the balance of Al and inevitable impurities. The ratio of (standard deviation of crystal grain size of Al alloy wire)/(average crystal grain size of Al alloy wire) is 0.57 or less, and the ratio of (diameter of Al alloy wire)/(average crystal grain size of Al alloy wire) is 10 or more.

According to JP 2012-229485 A, the aluminum alloy wire exhibits high mechanical strength and high electrical conductivity and is excellent in elongation, impact resistance, and flexible properties. Furthermore, the aluminum alloy wire of JP 2012-229485 A exhibits high temperature strength, and heat resistance. According to JP 2016-108617 A, the aluminum alloy wire is highly strengthened so as to be usable for small-diameter wires. It is flexible, easy to handle, light weight, and excellent in a flexible fatigue property. According to WO 2016/088888 A1, there can be obtained an aluminum alloy wire for use as a wire for hard-to-break electrical wiring bodies that exhibits high mechanical strength and excellent impact resistance and is usable for small-diameter wires.

In general, an aluminum (Al)-based material (e.g. pure Al and Al alloys) has poor solder wettability because a chemically stable oxide film is easily formed on its surface, so its electrical bonding is usually achieved through caulking. However, the long-term reliability of bonding by caulking of an Al-based material is said to be lower than that of solder bonding of a copper (Cu)-based material (e.g. pure Cu and Cu alloys). This is attributable to the fact that an Al-based material has a lower melting point than a Cu-bases material and therefore easily softens, which makes the adhesiveness at caulking joints prone to deteriorate with time.

If conductors of an Al-based material are used in power source wiring for high-electric power units or placed near high-temperature devices, the temperature of such conductors during use would reach around 200° C. In which case, the Al-based material would easily soften, and the adhesiveness at caulking joints would decrease, resulting in a decreased effective joining area at each joint (i.e. an increased electric resistance at each joint).

In other words, widening the scope of application of Al-based conductors requires the development of an Al-based material that has not only the basic characteristics (e.g. excellent electrical conductivity) but also a higher heat resistance than conventional Al-based materials.

SUMMARY OF THE INVENTION

In view of the foregoing, it is an objective of the present invention to provide an Al alloy conductor exhibiting mechanical properties and heat resistance that are balanced at a higher level than conventional Al alloy conductors while having an electrical conductivity comparable to that of any conventional Al-based material. Also, the invention has another objective to provide an Al alloy insulated wire including the Al alloy conductor. Furthermore, the invention has still another objective to provide a method for manufacturing the Al alloy insulated wire.

(I) According to one aspect of the present invention, there is provided an Al alloy conductor formed of an Al alloy. The Al alloy has a chemical composition including cobalt (Co) of 0.1 mass % or more and 1 mass % or less, at least one of scandium (Sc) of 0.1 mass % or more and 0.5 mass % or less and zirconium (Zr) of 0.2 mass % or more and 0.5 mass % or less, and the balance made up of Al and inevitable impurities. The Al alloy conductor has a parent phase (matrix) containing fine particles of a compound of at least one of the Sc and the Zr with the Al. The fine particles are dispersedly precipitated in the matrix.

(II) According to another aspect of the invention, there is provided an Al alloy insulated wire including a stranded wire composed of a plurality of Al alloy conductors twisted together and an insulation coating layer on a periphery of the stranded wire. Each of the plurality of Al alloy conductors is formed of an Al alloy that has a chemical composition including Co of 0.1 mass % or more and 1 mass % or less, at least one of Sc of 0.1 mass % or more and 0.5 mass % or less and Zr of 0.2 mass % or more and 0.5 mass % or less, and the balance made up of Al and inevitable impurities. Each of the plurality of Al alloy conductors has a matrix containing fine particles of a compound of at least one of the Sc and the Zr with the Al. The fine particles are dispersedly precipitated in the matrix.

In the above Al alloy conductor (I) and the above Al alloy insulated wire (II), the following modifications and changes can be made.

(i) The fine particles of the compound may have a grain size of 100 nm or less.

(ii) The chemical composition of the Al alloy may further comprise magnesium (Mg) of 0.01 mass % or more and 0.2 mass % or less.

(iii) The chemical composition of the Al alloy may further comprise silicon (Si) of 0.02 mass % or more and 0.09 mass % or less and iron (Fe) of 0.02 mass % or more and 0.09 mass % or less.

(iv) The Al alloy conductor may have an electrical conductivity of 57% IACS or more, a tensile strength of 115 MPa or more, a tensile elongation of 15% or more, and a 100,000 hour upper temperature limit of 200° C. or higher.

(v) The Al alloy conductor may have a wire diameter of 1 mm or less.

It is noted that in the present invention, "% IACS" refers to a ratio when the electrical conductivity of the copper specified as the International Annealed Copper Standard (IACS) is 100%, "tensile strength" and "tensile elongation" refer to values measured at room temperature, and a "100,000 hours upper temperature limit" refers to a temperature at which a Vickers hardness decreases by 10% after 100,000 hours of continuous use.

(III) According to still another aspect of the invention, there is provided a method for manufacturing an Al alloy insulated wire including a stranded wire composed of a plurality of Al alloy conductors twisted together and an insulation coating layer on a periphery of the stranded wire. Each of the plurality of Al alloy conductors is formed of an Al alloy that has a chemical composition including Co of 0.1 mass % or more and 1 mass % or less, at least one of Sc of 0.1 mass % or more and 0.5 mass % or less and Zr of 0.2 mass % or more and 0.5 mass % or less, and the balance made up of Al and inevitable impurities. Each of the plurality of Al alloy conductors has a matrix containing fine particles of a compound of at least one of the Sc and the Zr with the Al. The fine particles are dispersedly precipitated in the matrix. The method includes a raw material mixing and melting step, a casting step, a rough shaping step, a wire drawing step, a process annealing step, an aging heat treatment step, a conductor twisting step, and an insulation coating step. In the raw material mixing and melting step, raw materials for the Al alloy are mixed and melted to prepare molten metal such that the molten metal has the above chemical composition. In the casting step, the molten metal is solidified to form an ingot. In the rough shaping step, the ingot is subjected to machining to form a bar-shaped article. In the wire drawing step, the bar-shaped article is subjected to wire drawing to form an Al alloy wire. In the process annealing step, an annealing heat treatment is performed to relieve any processing strain caused by the wire drawing. In the aging heat treatment step, the Al alloy wire is subjected to an aging heat treatment to allow the fine particles of the compound to dispersedly precipitate to form an Al alloy conductor. In the conductor twisting step, a plurality of Al alloy conductors are twisted together to form the stranded wire. In the insulation coating step, the insulation coating layer is formed on the periphery of the stranded wire. The casting step is performed by a continual casting method that allows rapid solidification. The annealing heat treatment is a heat treatment performed within a temperature range of 250° C. or higher and 420° C. or lower. The aging heat treatment is a heat treatment performed within a temperature range of 270° C. or higher and 440° C. or lower and at a temperature that is higher than the temperature at which the annealing heat treatment is performed by 20° C. or more.

Advantages of the Invention

According to the invention, there can be provided an Al alloy conductor exhibiting mechanical properties and heat resistance that are balanced at a higher level than conventional Al alloy conductors while having an electrical conductivity comparable to that of any conventional Al-based material. Also, there can be provided an Al alloy insulated wire including the Al alloy conductor, and a method for manufacturing the Al alloy insulated wire. Because the Al alloy conductor and the Al alloy insulated wire including the Al alloy conductor according to the invention have a higher heat resistance than conventional Al-based materials, they are capable of being used in a higher temperature environment than conventional materials, which contributes to weight reduction of electrical/electronic wiring installed in vehicles.

DETAILED DESCRIPTION OF THE PREFERRED EMBODIMENTS

Figure 1:
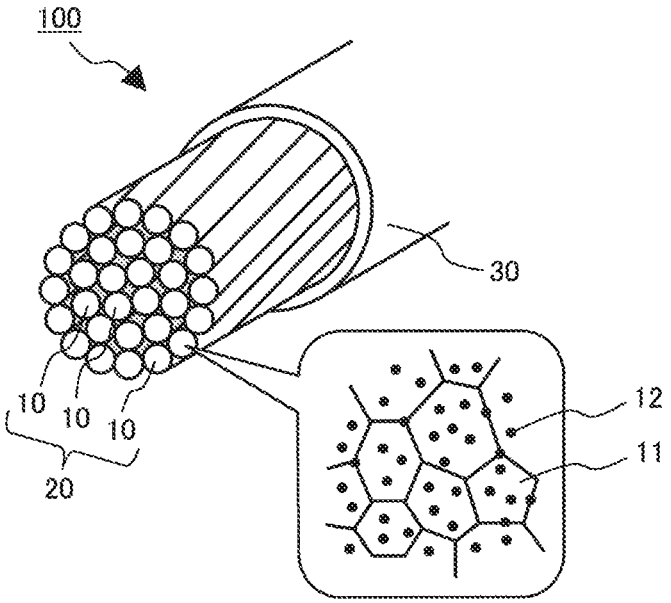
FIG. 1 is a schematic illustration showing a perspective view of an Al alloy insulated wire according to an embodiment of the invention.

The inventors carried out intensive research on the elemental balance of Al alloys that constitute Al alloy conductors and their manufacturing methods with an aim to develop an Al alloy conductor capable of being used in a higher temperature environment than conventional ones, as the conductor of an Al alloy insulated wire that is applicable to vehicles such as automobiles, trains, and aircraft. As a result, the inventors have found that with the chemical composition specified in the present invention, there can be obtained an Al alloy conductor exhibiting electrical conductivity, mechanical properties and heat resistance that are balanced at a higher level than conventional ones. The present invention was made based on this finding.

Preferred embodiments of the invention will be described hereinafter. However, the invention is not limited to the specific embodiments described below, but various combinations with known techniques and modifications based on known techniques are possible without departing from the technical idea of the invention, where appropriate.

[Chemical Composition of Al Alloy]

First, the chemical composition of an Al alloy according to an embodiment of the invention will be described. An Al alloy according to an embodiment of the invention contains Al as a main component, Co, at least one of Sc and Zr, and inevitable impurities. The Al alloy may further contain at least one of Mg, Si, and Fe as optional accessory components. In the invention, an "optional accessory component" refers to a component that the alloy may or may not contain.

(Co: 0.1 Mass % or More and 1 Mass % or Less)

The Co component is an accessory component of the Al alloy and contributes to improving the ductility of the Al alloy. Although the detailed mechanism underlying the effect of the Co component is not clarified, considering that the electrical conductivity decreases as the Co content increases, one possibility behind this is that the Co component would be present in the matrix (Al phase) crystal in the form of a supersaturated solid solution.

The Co content is preferably 0.1 mass % or more and 1 mass % or less. When the Co content is less than 0.1 mass %, the effect of improving the ductility is insufficient. Conversely, when the Co content is more than 1 mass %, the electrical conductivity of the Al alloy decreases greatly. The Co content is more preferably 0.2 mass % or more and 1 mass % or less, even more preferably 0.3 mass % or more and 0.8 mass % or less.

(Sc: 0.1 Mass % or More and 0.5 Mass % or Less)

The Sc component is another accessory component of the Al alloy and contributes to improving the heat resistance of the Al alloy. The Sc component forms a compound phase with the Al component (Al—Sc compound phase, e.g. $Al_3Sc$ phase) that precipitates finely and dispersedly in the matrix (in the matrix crystal grains and on the matrix crystal grain boundaries). It is thought that the heat resistance of the Al alloy is increased because the fine particles of the compound phase act as pinning points, which oppose moving of the crystal grain boundaries and dislocations.

The Sc content is preferably 0.1 mass % or more and 0.5 mass % or less. When the Sc content is less than 0.1 mass %, the effect of improving the heat resistance is insufficient. Meanwhile, when the Sc content is more than 0.5 mass %, the ductility of the Al alloy decreases. The Sc content is more preferably 0.2 mass % or more and 0.4 mass % or less.

(Zr: 0.2 Mass % or More and 0.5 Mass % or Less)

The Zr component is another accessory component of the Al alloy and contributes to improving the heat resistance of the Al alloy. The Zr component forms a compound phase with the Al component (Al—Zr compound phase, e.g. $Al_3Zr$ phase) that precipitates finely and dispersedly in the matrix. It is thought that the heat resistance of the Al alloy is increased because the fine particles of the compound phase act as pinning points, which oppose moving of the crystal grain boundaries and dislocations.

The Zr content is preferably 0.2 mass % or more and 0.5 mass % or less. When the Zr content is less than 0.2 mass %, the effect of improving the heat resistance is insufficient. However, when the Zr content is more than 0.5 mass %, the ductility of the Al alloy decreases. The Zr content is more preferably 0.3 mass % or more and 0.4 mass % or less.

(Mg: 0.01 Mass % or More and 0.2 Mass % or Less)

The Mg component is an optional accessory component of the Al alloy and contributes to improving the mechanical strength of the Al alloy. It is believed that the Mg component has this effect because it is present in the matrix crystal in the form of a solid solution (solid solution strengthening occurs). As mentioned before, an optional accessory component is a component that the Al alloy may or may not contain.

When the Al alloy contains the Mg component, the Mg content is preferably 0.01 mass % or more and 0.2 mass % or less. When the Mg content is less than 0.01 mass %, it only makes the effect of the Mg component insufficient (i.e. it does not cause any particular problems). Conversely, when the Mg content is more than 0.2 mass %, the ductility and the electrical conductivity of the Al alloy decrease. The Mg content is more preferably 0.02 mass % or more and 0.1 mass % or less, even more preferably 0.02 mass % or more and 0.09 mass % or less.

(Si: 0.02 Mass % or More and 0.09 Mass % or Less)

The Si component is another optional accessory component of the Al alloy and contributes to improving the mechanical strength of the Al alloy. It is believed that the Si component has this effect because it is present in the matrix crystal in the form of a solid solution (solid solution strengthening occurs). However, when the Si content is present in excess, the ductility of the Al alloy decreases. One possibility behind this is that it would inhibit the effect of the Co component.

When the Al alloy contains the Si component, the Si content is preferably 0.02 mass % or more and 0.09 mass % or less. When the Si content is less than 0.02 mass %, it only makes the effect of the Si component insufficient (i.e. it does not cause any particular problems). Meanwhile, when the Si content is more than 0.09 mass %, the ductility of the Al alloy decreases. The Si content is more preferably 0.04 mass % or more and 0.08 mass % or less.

(Fe: 0.02 Mass % or More and 0.09 Mass % or Less)

The Fe component is another optional accessory component of the Al alloy and contributes to improving the mechanical strength of the Al alloy. It is believed that the Fe component has this effect because it reduces the size of the matrix crystal grains. However, when the Fe content is present in excess, the ductility of the Al alloy decreases. One possibility behind this is that it would inhibit the effect of the Co component.

When the Al alloy contains the Fe component, the Fe content is preferably 0.02 mass % or more and 0.09 mass % or less. When the Fe content is less than 0.02 mass %, it only makes the effect of the Fe component insufficient (i.e. it does not cause any particular problems). On the other hand, when the Fe content is more than 0.09 mass %, the ductility of the Al alloy decreases. The Fe content is more preferably 0.04 mass % or more and 0.08 mass % or less.

(Balance: Al and Inevitable Impurities)

As mentioned above, the balance in the chemical composition is made up of Al as a main component and inevitable impurities. The inevitable impurities are impurities that are extremely difficult to avoid in manufacturing processes but should be reduced in content as much as possible (e.g. to 0.8 mass % or less in total). The inevitable impurities consist of elements other than the aforementioned elements, as a matter of course. Examples of the inevitable impurities include copper (Cu), manganese (Mn), zinc (Zn), titanium (Ti), and oxygen (O).

In terms of the electrical conductivity, the Al content is preferably 97 mass % or more, more preferably 98 mass % or more, even more preferably 98.5 mass % or more.

[Insulated Wire Including Al Alloy Conductor]

FIG. 1 is a schematic illustration showing a perspective view of an Al alloy insulated wire according to an embodiment of the present invention. As shown in FIG. 1, the Al alloy insulated wire 100 of the invention includes a stranded wire 20 made up of a plurality of Al alloy conductors 10 twisted together and an insulation coating layer 30 formed on the periphery of the stranded wire 20.

Furthermore, each of the Al alloy conductors 10 has a matrix 11 (Al phase) containing fine particles of an Al—Sc compound phase or Al—Zr compound phase 12 that are dispersedly precipitated. For a sufficient heat resistance improving effect, a grain size of the fine particles of the Al—Sc compound phase or Al—Zr compound phase 12 is preferably 100 nm or less, more preferably 80 nm or less, even more preferably 50 nm or less. When the grain size of the fine particles is more than 100 nm, the number of precipitates becomes too small, resulting in an insufficient effect of acting as pinning points, which oppose moving of the crystal grain boundaries and dislocations (i.e. an insufficient heat resistance improving effect).

There is no particular limitation on a wire diameter of the Al alloy conductors 10. However, from the viewpoint of flexibility, it is preferably 1 mm or less. There is no particular limitation on an outer diameter of the stranded wire 20 or an outer diameter of the Al alloy insulated wire 100, and it may be determined as appropriate based on the required amount of energizing current and insulation withstand voltage characteristics.

In order to achieve dispersed precipitation of the fine particles of the Al—Sc compound phase or Al—Zr compound phase 12 in the matrix of each finished Al alloy conductor, it is preferable that excessive precipitation and coarsening of the Al—Sc compound phase or Al—Zr compound phase 12 be prevented in an earlier stage of manufacturing process (e.g. in the stage of an ingot, a rough-machined article, and an article during wire drawing).

[Method for Manufacturing Al Alloy Insulated Wire]

Figure 2:
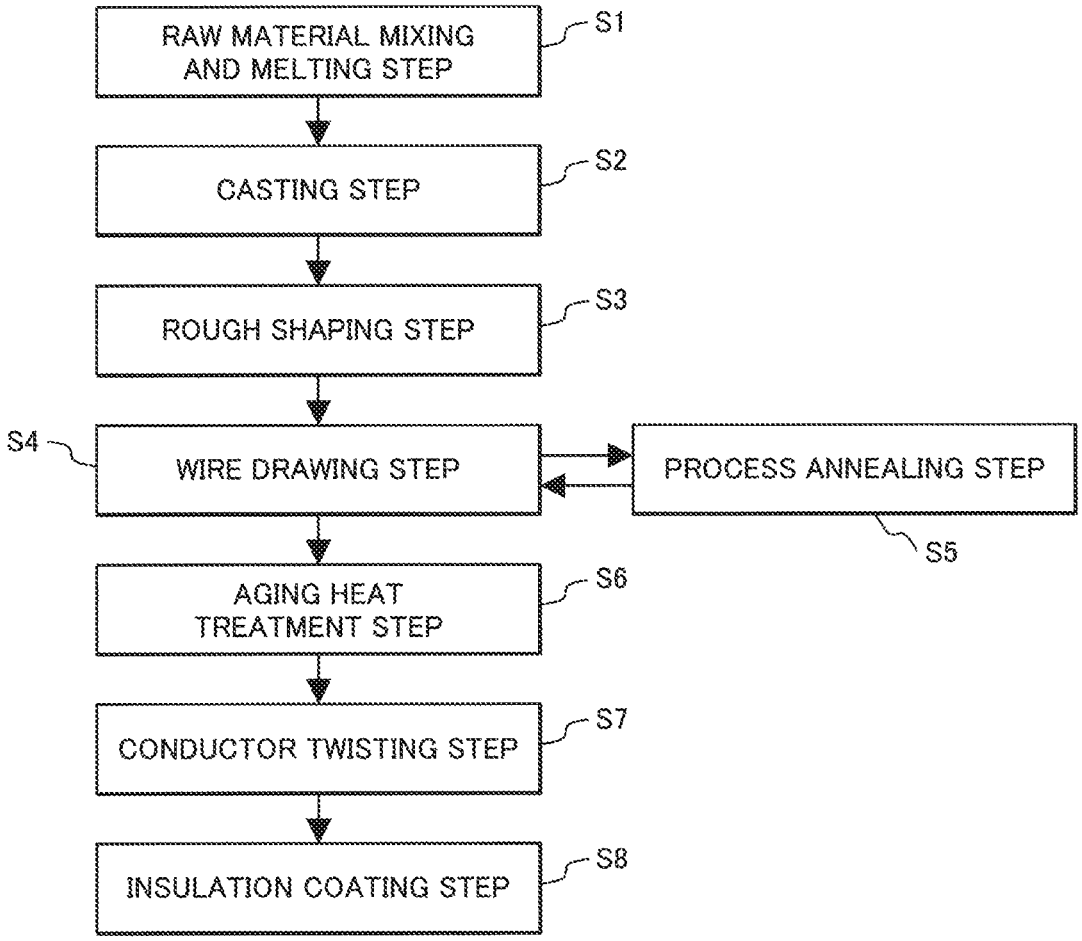
FIG. 2 is a process chart showing a method for manufacturing an Al alloy insulated wire according to an embodiment of the invention.

A method for manufacturing an Al alloy insulated wire according to another embodiment of the invention will be described hereinafter. FIG. 2 is a process chart showing a method for manufacturing an Al alloy insulated wire according to an embodiment of the invention. As shown in FIG. 2, first, a raw material mixing and melting step (Step 1: S1) is performed, in which Al alloy raw materials are mixed and melted to prepare molten metal such that the molten metal has a desired chemical composition [main component+accessory component(s)+optional accessory component(s), where appropriate]. There is no particular limitation on a method for mixing or melting the raw materials, and any conventional method in manufacturing Al alloy materials may be used.

Next, a casting step (Step 2: S2) is performed, in that the molten metal is solidified to form an ingot. There is no particular limitation on a casting method, and any conventional method in manufacturing Al alloy materials may be used. From the viewpoints of reducing the size of the matrix crystal grains and/or preventing the segregation of any accessory component element (e.g. Co, Sc, and Zr), a method that allows rapid solidification of the molten metal (e.g. continual casting) is preferably used. In other words, the segregation of any accessory component element (including undesired precipitation of the Al—Sc compound phase or Al—Zr compound phase in the stage of an ingot) can be prevented by rapidly solidifying the molten metal. Also, it is preferable to analyze the chemical composition of the ingot at this stage to see if it is within the desired range.

Next, a rough shaping step (Step 3: S3) is performed, in that the ingot is subjected to machining to form a bar-shaped article. There is no particular limitation on a machining method as long as a bar-shaped article that is suitable for a subsequent wire drawing step (e.g. an article with a diameter of around 5 to 50 mm) is obtained, and any conventional method in manufacturing Al alloy articles (e.g. rolling, swaging, and drawing) may be used.

Next, a wire drawing step (Step 4: S4) is performed, in that the bar-shaped article is subjected to wire drawing to form an Al alloy wire. There is no particular limitation on a machining method as long as an Al alloy wire with a desired diameter (e.g. a diameter of 1 mm or less) is obtained, and any conventional method in manufacturing Al alloy articles (e.g. drawing) may be used.

In addition, where appropriate, a process annealing step (Step 5: S5), in that an annealing heat treatment is performed to relieve any processing strain in the Al alloy article, may be performed at some point in the wire drawing step S4.

In the process annealing step S5, when the Al alloy article is made of an Al—Co—Sc-based alloy material, the annealing heat treatment is preferably performed within a temperatures range of 250° C. to 330° C. for an hour or less. This can prevent excessive precipitation and coarsening of the Al—Sc compound phase during the process annealing step S5.

On the other hand, when the Al alloy article is made of an Al—Co—Zr-based alloy material, the annealing heat treatment is preferably performed within a temperature range of 300° C. to 420° C. for two hours or less. This can prevent excessive precipitation and coarsening of the Al—Zr compound phase during the process annealing step S5.

Next, an aging heat treatment step (Step 6: S6) is performed, in that the Al alloy wire is subjected to an aging heat treatment to allow the Al—Sc compound phase or Al—Zr compound phase to precipitate finely and dispersedly. As mentioned before, dispersed precipitation of fine particles of the Al—Sc compound phase or Al—Zr compound phase 12 allows the Al alloy to exhibit an excellent heat resistance.

In the aging heat treatment step S6, when the Al alloy wire is made of an Al—Co—Sc-based alloy material, the aging heat treatment is preferably performed within a temperature range of 270° C. to 350° C. for two to six hours. Meanwhile, when the Al alloy wire is made of an Al—Co—Zr-based alloy material, the aging heat treatment is preferably performed within a temperature range of 320° C. to 440° C. for 10 to 60 hours. Also, the temperature of the aging heat treatment is preferably higher than the temperature of the annealing heat treatment by at least 20° C.

By performing the steps described above, an Al alloy conductor according to an embodiment of the invention is obtained. It is noted that an additional wire drawing process may be performed after the aging heat treatment step S6 to adjust the dimensions, shape, and hardness of the Al alloy conductor.

Next, a conductor twisting step (Step 7: S7) is performed, in that a plurality of the Al alloy conductors, each obtained as above, are prepared and twisted together to form a stranded wire. There is no particular limitation on a method for twisting the conductors together, and any conventional method in manufacturing stranded wires may be used. By this step, an Al alloy electric wire without an insulation coating (so-called naked wire) is obtained.

Next, an insulation coating step (Step 8: S8) is performed, in that an insulation coating layer is formed on a periphery of the stranded wire. There is no particular limitation on a method for insulating the stranded wire, and any conventional method in manufacturing insulated wires (e.g. applying an insulation paint on a wire and baking it, and resin extrusion coating) may be used. By this step, an Al alloy insulated wire according to an embodiment of the invention is obtained.

It is noted that a light-weight and heat-resistant wire harness can be manufactured by cutting the Al alloy insulated wire obtained as above to a desired length, bundling a plurality of the insulated wires, and mounting a connection terminal on each end of the bundled wires.

EXAMPLES

The present invention will be described in more detail hereinafter with examples and comparative examples. It is noted that the invention is not limited to these examples.

Experimental 1

Fabrication of Al Alloy Conductors of Examples A-1 to A-16 and Comparative Examples of A-1 to A-14

Conductor test pieces formed of Al alloys (Al—Co—Sc-based alloys) having nominal chemical compositions shown in Tables 1 and 2 below (Examples A-1 to A-16 and Comparative Examples A-1 to A-14) were fabricated according to the manufacturing procedure shown in FIG. 2. First, raw materials for each Al alloy were mixed, and the mixture was melted in the air using a high frequency melting furnace to prepare molten metal (the raw material mixing and melting step S1).

Next, the molten metal was solidified to form an ingot (diameter of 20 mm) by a twin roll continual casting method in which the molten metal was poured into a groove formed on a central portion of a water-cooled twin roll (the casting step S2). Also, a small piece was taken from the obtained ingot and subjected to an inductively coupled plasma atomic emission spectroscopy (ICP-AES) to confirm that each ingot had its intended chemical composition.

Next, each ingot is cut to an appropriate length and subjected to swaging to form a bar-shaped article (diameter of 9.5 mm) (the rough shaping step S3).

Next, the bar-shaped article was subjected to wire drawing to form an Al alloy wire (diameter of 0.6 mm) (the wire drawing step S4). In the middle of the wire drawing step S4, an annealing heat treatment was performed several times, the article held at 300° C. for 30 minutes in the air, to relieve any processing strain in the Al alloy article (the process annealing step S5).

Next, the Al alloy wire was subjected to an aging heat treatment, the Al alloy wire held at 320° C. for three hours in the air, to fabricate an Al alloy conductor (the aging heat treatment step S6).

Finally, the obtained Al alloy conductor was subjected to final wire drawing at an area reduction rate of 30% as a plastic deformation nearly corresponding to bonding by caulking to prepare a test piece for test evaluation (diameter of 0.5 mm).

Experimental 2

Fabrication of Pure Al Conductor as Reference Piece

A commercially available pure Al wire (purity of 4N, diameter of 1.5 mm) was prepared and subjected to the processes from the wire drawing step S4 to the final wire drawing in the same manner as Experimental 1 to prepare a test piece for test evaluation as a reference piece (diameter of 0.5 mm).

Experimental 3

Fabrication of Al Alloy Conductors of Examples B-1 to B-11 and Comparative Examples of B-1 to B-11

Conductor test pieces formed of Al alloys (Al—Co—Zr-based alloys) having nominal chemical compositions shown in Tables 3 and 4 below (Examples B-1 to B-11 and Comparative Examples B-1 to B-11) were fabricated in the same manner as Experimental 1, except that in the annealing heat treatment, the article was held at 350° C. for 30 minutes in the air, and in the aging heat treatment, the wire was held at 400° C. for 40 hours in the air.

Experimental 4

Test Evaluation of Al Alloy Conductors and Pure Al Conductor

The test pieces prepared in Experimental 1 to 3 (Examples A-1 to A-16, Comparative Examples A-1 to A-14, the reference piece, Examples B-1 to B-11, and Comparative Examples B-1 to B-11) were each subjected to electrical properties evaluation by a four-probe resistive method (electrical conductivity, % IACS), mechanical properties evaluation by a tensile test at room temperature (tensile strength, tensile elongation), and thermal properties evaluation (100,000 hours upper temperature limit).

The 100,000 hours upper temperature limit of each test piece was measured as follows. First, variations in the Vickers hardness of each Al alloy conductor test piece were measured with different heating temperatures and different heating holding durations. In this measurement, the Vickers hardness was measured at five points located in the longitudinal direction on the periphery of the test piece (the outer periphery of the Al alloy conductor) using a micro Vickers hardness meter, and the average of the five values was adopted as the Vickers hardness of the test piece.

Next, an isothermal softening curve was drawn for various temperatures based on the heating temperature, the heating holding duration, and the Vickers hardness. Subsequently, the duration required for the Vickers hardness to decrease by 10% from the initial value by heating was determined from the isothermal softening curve. Then, the temperature at which the test piece was expected to soften by 10% after 100,000 hours of continuous use was determined by Arrhenius-plotting the 10% softening duration and temperature, and the temperature thus determined was adopted as the 100,000 hours upper temperature limit of the test piece. Herein, it is assumed that all the softening phenomena accompanying a softening of 10% or less occur by the identical activation energy.

In the electrical properties evaluation, any electrical conductivity equal to or more than 57% IACS was determined as passed, and any conductivity less than 57% IACS was determined as failed. In the mechanical properties evaluation, any tensile strength equal to or more than 115 MPa and any tensile elongation equal to or more than 15% were determined as passed, and any tensile strength less than 115 MPa and any tensile elongation less than 15% were determined as failed. In the thermal properties evaluation, any 100,000 hour upper temperature limit equal to or higher than 200° C. was determined as passed, and any 100,000 hour upper temperature limit less than 200° C. was determined as failed. The results are shown in Tables 1 to 4.

TABLE 1

Nominal Chemical Compositions and Test Evaluation Results of Examples A-1 to A-16.

| | Nominal Chemical Composition (mass %) | | | | | Test Evaluation Results | | | |
|---|---|---|---|---|---|---|---|---|---|
| | Co | Sc | Mg | Si | Fe | Electrical Conductivity (% IACS) | Tensile Strength (MPa) | Tensile Elongation (%) | 100,000 Hour Upper Temperature Limit |
| Example A-1 | 0.3 | 0.2 | — | 0.07 | 0.08 | 60.0 | 125 | 20 | Passed |
| Example A-2 | 0.5 | 0.2 | — | 0.07 | 0.08 | 59.7 | 128 | 22 | Passed |
| Example A-3 | 1.0 | 0.2 | — | 0.07 | 0.08 | 59.0 | 133 | 22 | Passed |
| Example A-4 | 0.5 | 0.2 | — | 0.04 | 0.04 | 60.6 | 127 | 23 | Passed |
| Example A-5 | 0.5 | 0.2 | — | 0.02 | 0.03 | 60.9 | 122 | 24 | Passed |
| Example A-6 | 0.5 | 0.2 | 0.02 | 0.07 | 0.08 | 59.8 | 145 | 19 | Passed |
| Example A-7 | 0.5 | 0.2 | 0.06 | 0.07 | 0.08 | 59.4 | 148 | 17 | Passed |
| Example A-8 | 0.5 | 0.2 | 0.1 | 0.07 | 0.08 | 59.1 | 152 | 16 | Passed |
| Example A-9 | 0.3 | 0.4 | — | 0.07 | 0.08 | 59.4 | 155 | 16 | Passed |
| Example A-10 | 0.5 | 0.4 | — | 0.07 | 0.08 | 59.3 | 158 | 19 | Passed |
| Example A-11 | 1.0 | 0.4 | — | 0.07 | 0.08 | 59.0 | 168 | 16 | Passed |
| Example A-12 | 0.5 | 0.4 | 0.06 | 0.07 | 0.08 | 59.3 | 166 | 15 | Passed |
| Example A-13 | 0.3 | 0.12 | — | 0.07 | 0.08 | 61.1 | 115 | 26 | Passed |
| Example A-14 | 0.5 | 0.12 | — | 0.07 | 0.08 | 60.8 | 117 | 28 | Passed |
| Example A-15 | 1.0 | 0.12 | — | 0.07 | 0.08 | 59.0 | 124 | 24 | Passed |
| Example A-16 | 0.5 | 0.12 | 0.06 | 0.07 | 0.06 | 59.4 | 137 | 20 | Passed |

Balance in each nominal chemical composition is made up of Al and inevitable impurities.

TABLE 2

Nominal Chemical Compositions and Test Evaluation Results of Reference Piece and Comparative Examples A-1 to A-14.

| | Nominal Chemical Composition (mass %) | | | | | Test Evaluation Results | | | |
|---|---|---|---|---|---|---|---|---|---|
| | Co | Sc | Mg | Si | Fe | Electrical Conductivity (% IACS) | Tensile Strength (MPa) | Tensile Elongation (%) | 100,000 Hour Upper Temperature Limit |
| Reference Piece | — | — | — | — | — | 63.6 | 71 | 38 | Failed |
| Comparative Example A-1 | 0.5 | 0.2 | — | <0.005 | <0.005 | 61.6 | 105 | 25 | Passed |
| Comparative Example A-2 | 0.5 | 0.2 | — | 0.14 | 0.08 | 57.9 | 131 | 11 | Passed |
| Comparative Example A-3 | 0.5 | 0.2 | — | 0.3 | 0.08 | 56.3 | 136 | 10 | Passed |
| Comparative Example A-4 | 0.5 | 0.2 | — | 0.5 | 0.08 | 55.6 | 144 | 10 | Passed |
| Comparative Example A-5 | 0.5 | 0.2 | 0.06 | 0.3 | 0.08 | 56.0 | 146 | 7 | Passed |
| Comparative Example A-6 | 0.3 | 0.2 | — | 0.07 | 0.15 | 58.5 | 135 | 10 | Passed |
| Comparative Example A-7 | 0.3 | 0.2 | — | 0.07 | 0.3 | 58.1 | 142 | 11 | Passed |
| Comparative Example A-8 | 0.5 | 0.2 | — | 0.07 | 0.3 | 57.9 | 145 | 9 | Passed |
| Comparative Example A-9 | 0.5 | 0.2 | — | 0.07 | 0.5 | 57.6 | 148 | 10 | Passed |
| Comparative Example A-10 | 0.5 | 0.2 | 0.06 | 0.07 | 0.3 | 56.2 | 155 | 6 | Passed |
| Comparative Example A-11 | — | 0.2 | — | 0.07 | 0.08 | 60.7 | 105 | 11 | Passed |

TABLE 2-continued

Nominal Chemical Compositions and Test Evaluation Results of Reference Piece and Comparative Examples A-1 to A-14.

| | Nominal Chemical Composition (mass %) | | | | | Test Evaluation Results | | | |
|---|---|---|---|---|---|---|---|---|---|
| | Co | Sc | Mg | Si | Fe | Electrical Conductivity (% IACS) | Tensile Strength (MPa) | Tensile Elongation (%) | 100,000 Hour Upper Temperature Limit |
| Comparative Example A-12 | 0.3 | — | — | 0.07 | 0.08 | 60.5 | 92 | 32 | Failed |
| Comparative Example A-13 | 0.5 | — | — | 0.07 | 0.08 | 60.1 | 98 | 33 | Failed |
| Comparative Example A-14 | 1.0 | — | — | 0.08 | 0.08 | 59.6 | 105 | 36 | Failed |

Balance in each nominal chemical composition is made up of Al and inevitable impurities.

As shown in Table 1, it is observed that Examples A-1 to A-16, which are Al alloy conductors according to an embodiment of the invention, each has an electrical conductivity of 59% IACS or more, a tensile strength of 115 MPa or more, a tensile elongation of 15% or more, and a 100,000 hour upper temperature limit of 200° C. or higher.

In contrast, as shown in Table 2, the reference piece, a pure Al conductor, has a failed tensile strength and a failed 100,000 hour upper temperature limit, although it exhibits a high electric conductivity and a high tensile elongation. Also, Comparative Examples A-1 to A-14, which are Al alloy conductors that are out of the specifications in the invention, are failed in at least one of tensile strength, tensile elongation, and 100,000 hour upper temperature limit.

TABLE 3

Nominal Chemical Compositions and Test Evaluation Results of Examples B-1 to B-11.

| | Nominal Chemical Composition (mass %) | | | | | Test Evaluation Results | | | |
|---|---|---|---|---|---|---|---|---|---|
| | Co | Zr | Mg | Si | Fe | Electrical Conductivity (% IACS) | Tensile Strength (MPa) | Tensile Elongation (%) | 100,000 Hour Upper Temperature Limit |
| Example B-1 | 0.3 | 0.3 | — | 0.07 | 0.08 | 59.9 | 117 | 19 | Passed |
| Example B-2 | 0.5 | 0.3 | — | 0.07 | 0.08 | 58.6 | 118 | 20 | Passed |
| Example B-3 | 1.0 | 0.3 | — | 0.07 | 0.08 | 58.2 | 123 | 19 | Passed |
| Example B-4 | 0.5 | 0.3 | — | 0.04 | 0.05 | 58.9 | 115 | 22 | Passed |
| Example B-5 | 0.5 | 0.3 | 0.02 | 0.07 | 0.08 | 57.8 | 135 | 16 | Passed |
| Example B-6 | 0.5 | 0.3 | 0.06 | 0.07 | 0.08 | 57.7 | 138 | 16 | Passed |
| Example B-7 | 0.5 | 0.3 | 0.1 | 0.07 | 0.08 | 57.2 | 142 | 15 | Passed |
| Example B-8 | 0.3 | 0.4 | — | 0.07 | 0.08 | 58.7 | 135 | 18 | Passed |
| Example B-9 | 0.5 | 0.4 | — | 0.07 | 0.08 | 58.5 | 138 | 19 | Passed |
| Example B-10 | 1.0 | 0.4 | — | 0.07 | 0.08 | 58.2 | 142 | 16 | Passed |
| Example B-11 | 0.5 | 0.4 | 0.06 | 0.07 | 0.08 | 57.4 | 146 | 17 | Passed |

Balance in each nominal chemical composition is made up of Al and inevitable impurities.

TABLE 4

Nominal Chemical Compositions and Test Evaluation Results of Comparative Examples B-1 to B-11.

| | Nominal Chemical Composition (mass %) | | | | | Test Evaluation Results | | | |
|---|---|---|---|---|---|---|---|---|---|
| | Co | Zr | Mg | Si | Fe | Electrical Conductivity (% IACS) | Tensile Strength (MPa) | Tensile Elongation (%) | 100,000 Hour Upper Temperature Limit |
| Comparative Example B-1 | 0.5 | 0.3 | — | <0.005 | <0.005 | 60.8 | 92 | 22 | Passed |
| Comparative Example B-2 | 0.5 | 0.3 | — | 0.14 | 0.08 | 56.2 | 121 | 9 | Passed |
| Comparative Example B-3 | 0.5 | 0.3 | — | 0.3 | 0.08 | 55.7 | 126 | 8 | Passed |

TABLE 4-continued

Nominal Chemical Compositions and Test Evaluation Results of Comparative Examples B-1 to B-11.

| | Nominal Chemical Composition (mass %) | | | | | Test Evaluation Results | | | |
|---|---|---|---|---|---|---|---|---|---|
| | Co | Zr | Mg | Si | Fe | Electrical Conductivity (% IACS) | Tensile Strength (MPa) | Tensile Elongation (%) | 100,000 Hour Upper Temperature Limit |
| Comparative Example B-4 | 0.5 | 0.3 | — | 0.5 | 0.08 | 55.3 | 134 | 8 | Passed |
| Comparative Example B-5 | 0.5 | 0.3 | 0.06 | 0.3 | 0.08 | 54.8 | 136 | 6 | Passed |
| Comparative Example B-6 | 0.3 | 0.3 | — | 0.07 | 0.15 | 56.5 | 125 | 7 | Passed |
| Comparative Example B-7 | 0.3 | 0.3 | — | 0.07 | 0.3 | 56.2 | 122 | 9 | Passed |
| Comparative Example B-8 | 0.5 | 0.3 | — | 0.07 | 0.3 | 56.1 | 125 | 7 | Passed |
| Comparative Example B-9 | 0.3 | 0.3 | 0.06 | 0.07 | 0.3 | 55.7 | 142 | 7 | Passed |
| Comparative Example B-10 | 0.5 | 0.3 | — | 0.08 | 0.5 | 55.9 | 138 | 9 | Passed |
| Comparative Example B-11 | 0.5 | 0.1 | — | 0.08 | 0.08 | 59.6 | 115 | 29 | Failed |

Balance in each nominal chemical composition is made up of Al and inevitable impurities.

As shown in Table 3, it is observed that Examples B-1 to B-11, which are Al alloy conductors according to an embodiment of the invention, each has an electrical conductivity of 57% IACS or more, a tensile strength of 115 MPa or more, a tensile elongation of 15% or more, and a 100,000 hour upper temperature limit of 200° C. or higher.

In contrast, as shown in Table 4, Comparative Examples B-1 to B-11, which are Al alloy conductors that are out of the specifications in the invention, are failed in at least one of tensile strength, tensile elongation, and 100,000 hour upper temperature limit.

Experimental 5

Microstructure Observation of Al Alloy Conductors

The test pieces of Examples A-1 and B-1 were subjected to microstructure observation by a transmission electron microscopy (TEM). As a result, it was found that Example A-1 had fine particles with the grain sizes of approximately 10 to 50 nm dispersedly precipitated in the matrix (in the matrix crystal grains and on the matrix crystal boundaries). The number of precipitates in the matrix in a TEM image (field of view: 0.5 μm×0.5 μm) was 120. Also, an analysis of a diffraction pattern of the precipitates obtained by selected area electron diffraction revealed that the dispersed fine particles were an $Al_3Sc$ phase.

Similarly, it was observed that Example B-1 also had fine particles with the grain sizes of approximately 10 to 80 nm dispersedly precipitated in the matrix. The number of precipitates in the matrix in a TEM image (field of view: 0.5 μm×0.5 μm) was 90. Also, an analysis of a diffraction pattern of the precipitates obtained by selected area electron diffraction revealed that the dispersed fine particles were an $Al_3Zr$ phase.

The invention is not limited to the above described embodiments, and various modifications can be made. Also, the above embodiments are given for the purpose of detailed explanation only, and the invention is not intended to include all features and aspects of the embodiments described above. Also, a part of an embodiment may be replaced by known art, or added with known art. That is, a part of an embodiment of the invention may be combined with known art and modified based on known art without departing from the technical idea of the invention.

What is claimed is:

1. An aluminum alloy conductor formed of an aluminum alloy, the aluminum alloy having a chemical composition comprising:

cobalt of 0.1 mass % or more and 1 mass % or less;

at least one of scandium of 0.1 mass % or more and 0.5 mass % or less and zirconium of 0.2 mass % or more and 0.5 mass % or less; and a balance made up of aluminum and inevitable impurities, wherein the aluminum alloy conductor has a matrix containing fine particles of a compound of at least one of the scandium and the zirconium with the aluminum, and wherein the fine particles are dispersedly precipitated in the matrix.

2. The aluminum alloy conductor according to claim 1, wherein the fine particles of the compound have a grain size of 100 nm or less.

3. The aluminum alloy conductor according to claim 2, wherein the chemical composition of the aluminum alloy further comprises silicon of 0.02 mass % or more and 0.09 mass % or less and iron of 0.02 mass % or more and 0.09 mass % or less.

4. The aluminum alloy conductor according to claim 1, wherein the chemical composition of the aluminum alloy further comprises magnesium of 0.01 mass % or more and 0.2 mass % or less.

5. The aluminum alloy conductor according to claim 4, wherein the chemical composition of the aluminum alloy further comprises silicon of 0.02 mass % or more and 0.09 mass % or less and iron of 0.02 mass % or more and 0.09 mass % or less.

6. The aluminum alloy conductor according to claim 1, wherein the chemical composition of the aluminum alloy further comprises silicon of 0.02 mass % or more and 0.09 mass % or less and iron of 0.02 mass % or more and 0.09 mass % or less.

7. The aluminum alloy conductor according to claim 1, wherein the aluminum alloy conductor has an electrical conductivity of 57% IACS or more, a tensile strength of 115 MPa or more, a tensile elongation of 15% or more, and a 100,000 hour upper temperature limit of 200° C. or higher.

8. The aluminum alloy conductor according to claim 1, wherein the aluminum alloy conductor has a wire diameter of 1 mm or less.

9. An aluminum alloy insulated wire, comprising a stranded wire and an insulation coating layer on a periphery of the stranded wire, the stranded wire comprising:

a plurality of aluminum alloy conductors twisted together, each of the plurality of aluminum alloy conductors being formed of an aluminum alloy having a chemical composition comprising:

cobalt of 0.1 mass % or more and 1 mass % or less;

at least one of scandium of 0.1 mass % or more and 0.5 mass % or less and zirconium of 0.2 mass % or more and 0.5 mass % or less; and a balance made up of aluminum and inevitable impurities, wherein the aluminum alloy conductor has a matrix containing fine particles of a compound of at least one of the scandium and the zirconium with the aluminum, and wherein the fine particles are dispersedly precipitated in the matrix.

10. The aluminum alloy insulated wire according to claim 9, wherein the fine particles of the compound have a grain size of 100 nm or less.

11. The aluminum alloy insulated wire according to claim 10, wherein the chemical composition of the aluminum alloy further comprises silicon of 0.02 mass % or more and 0.09 mass % or less and iron of 0.02 mass % or more and 0.09 mass % or less.

12. The aluminum alloy insulated wire according to claim 9, wherein the chemical composition of the aluminum alloy further comprises magnesium of 0.01 mass % or more and 0.2 mass % or less.

13. The aluminum alloy insulated wire according to claim 12, wherein the chemical composition of the aluminum alloy further comprises silicon of 0.02 mass % or more and 0.09 mass % or less and iron of 0.02 mass % or more and 0.09 mass % or less.

14. The aluminum alloy insulated wire according to claim 9, wherein the chemical composition of the aluminum alloy further comprises silicon of 0.02 mass % or more and 0.09 mass % or less and iron of 0.02 mass % or more and 0.09 mass % or less.

15. The aluminum alloy insulated wire according to claim 9, wherein the aluminum alloy conductor has an electrical conductivity of 57% IACS or more, a tensile strength of 115 MPa or more, a tensile elongation of 15% or more, and a 100,000 hour upper temperature limit of 200° C. or higher.

16. The aluminum alloy insulated wire according to claim 9, wherein the aluminum alloy conductor has a wire diameter of 1 mm or less.

17. A method for manufacturing an aluminum alloy insulated wire, the insulated wire comprising a stranded wire and an insulation coating layer on a periphery of the stranded wire, the stranded wire comprising:

a plurality of aluminum alloy conductors twisted together, each of the plurality of aluminum alloy conductors being formed of an aluminum alloy having a chemical composition comprising:

cobalt of 0.1 mass % or more and 1 mass % or less;

at least one of scandium of 0.1 mass % or more and 0.5 mass % or less and zirconium of 0.2 mass % or more and 0.5 mass % or less; and a balance made up of aluminum and inevitable impurities, wherein the aluminum alloy conductor has a matrix containing fine particles of a compound of at least one of the scandium and the zirconium with the aluminum, and wherein the fine particles are dispersedly precipitated in the matrix, the method comprising:

a raw material mixing and melting step of mixing and melting raw materials of the aluminum alloy to prepare molten metal such that the molten metal has the chemical composition;

a casting step of solidifying the molten metal to form an ingot, the casting step being performed by a continual casting method that allows rapid solidification;

a rough shaping step of subjecting the ingot to machining to form a bar-shaped article;

a wire drawing step of subjecting the bar-shaped article to wire drawing to form an aluminum alloy wire;

a process annealing step of performing an annealing heat treatment to relieve any processing strain caused by the wire drawing, the annealing heat treatment being a heat treatment performed within a temperature range of 250° C. or higher and 420° C. or lower;

an aging heat treatment step of subjecting the aluminum alloy wire to an aging heat treatment to allow the fine particles of the compound to dispersedly precipitate to form an aluminum alloy conductor, the aging heat treatment being a heat treatment performed within a temperature range of 270° C. or higher and 440° C. or lower and at a temperature that is higher than the temperature at which the annealing heat treatment is performed by 20° C. or more;

a conductor twisting step of twisting a plurality of aluminum alloy conductors together to form the stranded wire; and an insulation coating step of forming the insulation coating layer on the periphery of the stranded wire.

* * * * *